US011813716B2

(12) United States Patent
Kim et al.

(10) Patent No.: US 11,813,716 B2
(45) Date of Patent: Nov. 14, 2023

(54) SUBSTRATE PROCESSING APPARATUS HAVING CHAMBER COVER

(71) Applicant: Samsung Electronics Co., Ltd., Suwon-si (KR)

(72) Inventors: Jwahyeon Kim, Cheonan-si (KR); Sungjoon Joo, Cheonan-si (KR); Bongsu Cho, Asan-si (KR); Kyungho Ha, Cheonan-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 17/709,941

(22) Filed: Mar. 31, 2022

(65) Prior Publication Data

US 2023/0017080 A1 Jan. 19, 2023

(30) Foreign Application Priority Data

Jul. 16, 2021 (KR) ..... 10-2021-0093462

(51) Int. Cl.
*B24B 55/06* (2006.01)
*B24B 37/34* (2012.01)

(52) U.S. Cl.
CPC ..... *B24B 55/06* (2013.01); *B24B 37/34* (2013.01)

(58) Field of Classification Search
CPC ..... B24B 55/04; B24B 55/06; B24B 27/0076; B24B 7/228; B24B 37/34; B24B 37/10; B24B 41/02; H01L 21/67092
USPC ..... 451/57, 65, 451, 453
See application file for complete search history.

(56) References Cited

U.S. PATENT DOCUMENTS

| | | | | |
|---|---|---|---|---|
| 6,332,826 | B1 | 12/2001 | Katsuoka et al. | |
| 6,413,146 | B1 | 7/2002 | Katsuoka et al. | |
| 6,500,051 | B1 | 12/2002 | Nishi et al. | |
| 6,918,814 | B2 | 7/2005 | Katsuoka et al. | |
| 6,997,782 | B2 | 2/2006 | Nishi et al. | |
| 7,022,000 | B2 * | 4/2006 | Mizomoto | B24B 37/345 451/65 |
| 7,101,255 | B2 | 9/2006 | Katsuoka et al. | |
| 8,165,710 | B2 | 4/2012 | Torikoshi et al. | |
| 8,172,643 | B2 | 5/2012 | Yilmaz et al. | |
| 2005/0142991 | A1 | 6/2005 | Nakao et al. | |
| 2008/0318494 | A1 * | 12/2008 | Hu | B24B 55/12 451/37 |

FOREIGN PATENT DOCUMENTS

| | | | | |
|---|---|---|---|---|
| KR | 10-2000-0070318 | A | 11/2000 | |
| KR | 20180102012 | A * | 9/2018 | B24B 37/10 |

OTHER PUBLICATIONS

English translation of KR 20180102012A (Year: 2018).*

* cited by examiner

*Primary Examiner* — Joel D Crandall
*Assistant Examiner* — Sukwoo James Chang
(74) *Attorney, Agent, or Firm* — Harness, Dickey & Pierce, P.L.C.

(57) ABSTRACT

A substrate processing apparatus includes a first polishing chamber, a second polishing chamber, a dry polishing chamber and a loading chamber on a turntable. The dry polishing chamber includes a polishing device on the turntable, and a chamber cover including a cover plate, an interception filter at an intake port at the cover plate, and a particle barrier connected to the cover plate. The particle barrier faces the interception filter, and is between the polishing device and the interception filter.

20 Claims, 11 Drawing Sheets

SUBSTRATE PROCESSING APPARATUS HAVING CHAMBER COVER

CROSS-REFERENCE TO THE RELATED APPLICATION

This application claims priority from Korean Patent Application No. 10-2021-0093462, filed on Jul. 16, 2021, in the Korean Intellectual Property Office, the disclosure of which is incorporated herein by reference in its entirety.

BACKGROUND

1. Field

The example embodiments of the disclosure relate to a substrate processing apparatus having a chamber cover.

2. Description of the Related Art

In a semiconductor device manufacturing process, a polishing process for planarizing a surface of a wafer while adjusting a thickness of the wafer is used. Since the polishing process is a process of processing a substrate through friction, technology for reducing production of foreign matter may be advantageous.

SUMMARY

The example embodiments of the disclosure provide a substrate processing apparatus having a chamber cover.

A substrate processing apparatus according to example embodiments of the disclosure may include a first polishing chamber, a second polishing chamber, a dry polishing chamber and a loading chamber on a turntable. The dry polishing chamber may include a polishing device on the turntable, and a chamber cover including a cover plate, an interception filter at an intake port at the cover plate, and a particle barrier connected to the cover plate. The particle barrier may face the interception filter, and may be between the polishing device and the interception filter.

A substrate processing apparatus according to example embodiments of the disclosure may include a first polishing chamber, a second polishing chamber, a dry polishing chamber and a loading chamber on a turntable. The dry polishing chamber may include a polishing device on the turntable, and a chamber cover including a cover plate, a plurality of interception filters at an intake port at the cover plate, and a particle barrier connected to the cover plate. The particle barrier may face the plurality of the interception filters, and may be between the polishing device and the interception filters.

A substrate processing apparatus according to example embodiments of the disclosure may include a first polishing chamber, a second polishing chamber, a dry polishing chamber and a loading chamber on a turntable. The dry polishing chamber may include an upper exhaust port and a side exhaust port at an upper surface and a side surface of the dry polishing chamber, respectively, a chuck table on the turntable, a polishing device on the chuck table, the polishing device including a spindle, and a polishing wheel under the spindle, and a chamber cover including a cover plate, an interception filter at an intake port at the cover plate, and a particle barrier connected to the cover plate. The particle barrier may face the interception filter, may be between the polishing device and the interception filter, and may be open only at a lower surface thereof.

DETAILED DESCRIPTION OF EXAMPLE EMBODIMENTS

Figure 1:
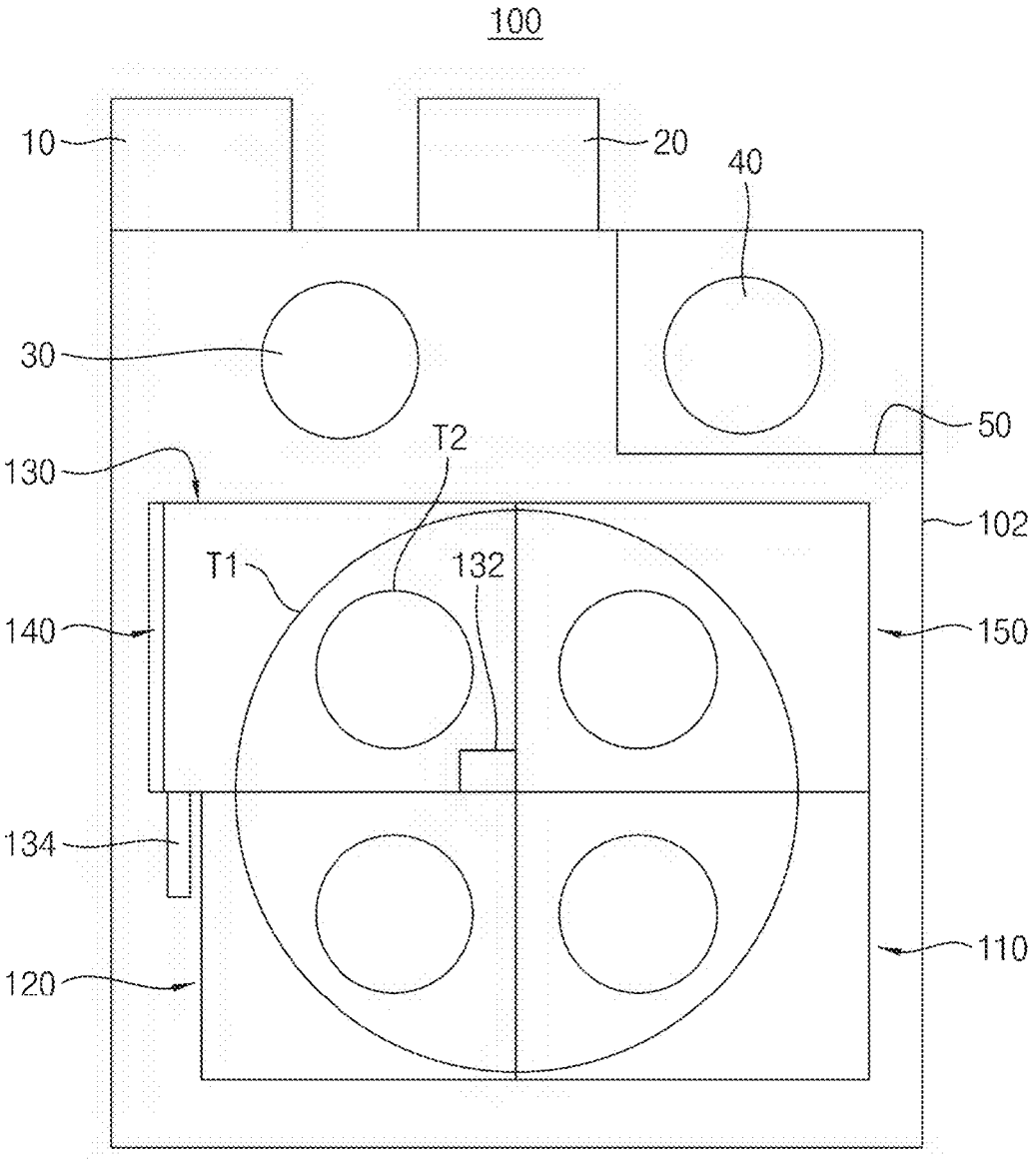
FIG. 1 is a plan view of a substrate processing apparatus according to example embodiments of the present inventive concepts.

FIG. 1 is a plan view of a substrate processing apparatus according to example embodiments of the present inventive concepts.

Referring to FIG. 1, a substrate processing apparatus 100 may include an outer wall 102, a first polishing chamber 110, a second polishing chamber 120, a dry polishing chamber 130, a chamber cover 140, and/or a loading chamber 150.

The first polishing chamber 110, the second polishing chamber 120, the dry polishing chamber 130, and/or the loading chamber 150 may be disposed inside the outer wall 102 of the substrate processing apparatus 100. For example, the substrate process apparatus 100 may include a turntable T1, and a chuck table T2 disposed on the turntable T1. The first polishing chamber 110, the second polishing chamber 120, the dry polishing chamber 130, and/or the loading chamber 150 may be disposed to divide the turntable T1 into quadrant portions. Chuck tables T2 may be disposed in the first polishing chamber 110, the second polishing chamber 120, the dry polishing chamber 130, and/or the loading chamber 150, respectively. For example, the turntable T1 may horizontally rotate about a central axis perpendicular to the ground, and the chuck table T2 may be sequentially provided to the first polishing chamber 110, the second polishing chamber 120, the dry polishing chamber 130 and/or the loading chamber 150 by the turntable T1.

The substrate processing apparatus 100 may further include a loading port 10, a loading port 20, a positioning table 30, and/or a spinner table 40. Before execution of a substrate processing process, a wafer received in the loading port 10 may be transferred onto the positioning table 30, which includes a position alignment function, by a transfer device (not shown) such as a robot. The wafer position-aligned on the positioning table 30 may be transferred onto the turntable T1, and, for example, may be provided to the loading chamber 150. The loading chamber 150 may be used for preparation for initiation of a substrate processing process.

The substrate processing process, for example, a substrate polishing process, may proceed in the order of primary polishing, secondary polishing, third polishing, cleaning, etc. The primary polishing may be performed in the first polishing chamber 110, and a wafer on the chuck table T2 in the first polishing chamber 110 may be subjected to rough grinding. The rough-ground wafer may be provided to the second polishing chamber 120 by the turntable T1, and may be subjected to the secondary polishing. In the second polishing chamber 120, the wafer may be subjected to fine grinding. Thereafter, the finely-ground wafer may be provided to the dry polishing chamber 130 by the turntable T1, and may be subjected to the third polishing. In the dry polishing chamber 130, the wafer may be subjected to dry polishing. That is, the wafer may be polished to desired thicknesses in the primary and secondary polishing processes, respectively, and the dry polishing process may be performed for the wafer in the third polishing and, as such, a surface of the wafer may be mirrored.

Subsequently, the dry-polished wafer may be provided to the spinner table 40 by the transfer device (not shown), and may then be subjected to the cleaning process. On the spinner table 40, dust, foreign matter, etc. remaining on the wafer may be finally removed. The cleaned wafer may be transferred to the loading port 20.

The cleaned wafer may be transferred to another device. For example, the wafer may be transferred to a mounting device and, as such, a tape used to bond the wafer in the polishing process may be removed, a new tape such as a die attach film (DAF) may be attached to the wafer, and wafer ID discrimination, etc. may be performed.

The substrate processing apparatus 100 may further include a fan filter unit 50. The fan filter unit 50 may be disposed at an upper portion of the substrate processing apparatus 100, and, for example, may be disposed at a position corresponding to the spinner table 40. The fan filter unit 50 may blow air downwards in the substrate processing apparatus 100 by a motor (not shown) connected to the fan filter unit 50, and may introduce air into the substrate process apparatus 100.

Figure 2:
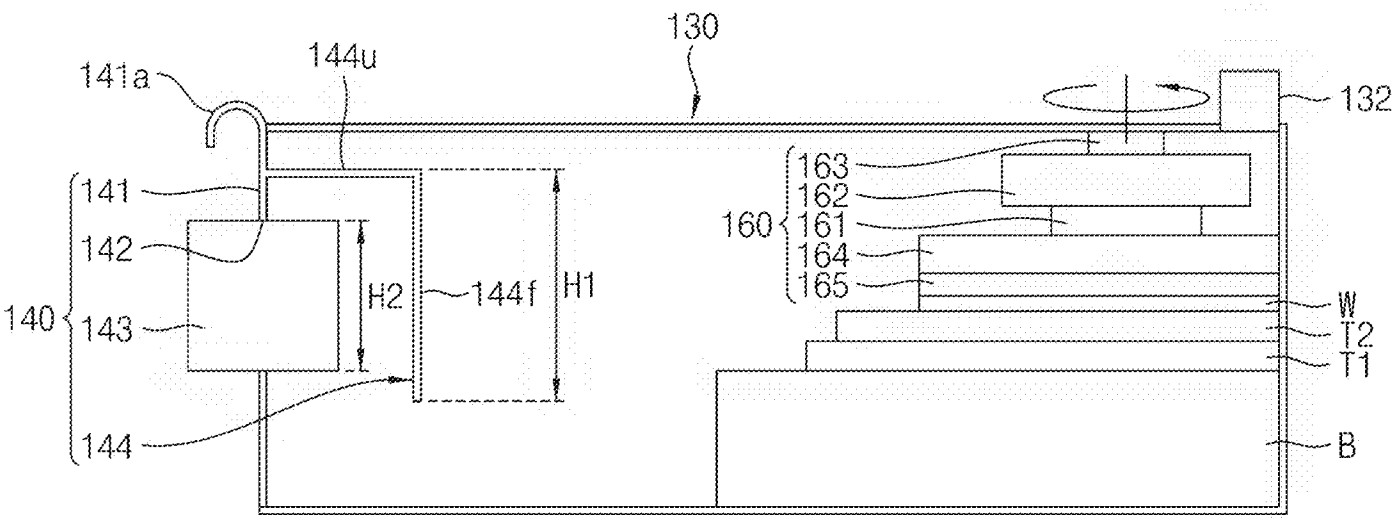
FIG. 2 is a vertical sectional view of the dry polishing chamber shown in FIG. 1.

FIG. 2 is a vertical sectional view of the dry polishing chamber shown in FIG. 1.

Referring to FIGS. 1 and 2, the dry polishing chamber 130 may include an upper exhaust port 132, a side exhaust port 134 (shown in FIG. 1), the chamber cover 140, a base B, the turntable T1, the chuck table T2, and/or a polishing device 160. The upper exhaust port 132 and the side exhaust port 134 may be disposed at an upper portion and a side surface of the dry polishing chamber 130, respectively, may suck air out of the dry polishing chamber 130, and may then outwardly exhaust the sucked air. That is, the upper exhaust port 132 and the side exhaust port 134 may outwardly exhaust particles, such as foreign matter, etc., produced in the dry polishing process. The chamber cover 140 may constitute an outer wall of the dry polishing chamber 130.

The base B may be disposed at a lower portion of the dry polishing chamber 130, and the turntable T1 may be installed on an upper surface of the base B. As described with reference to FIG. 1, the turntable T1 may horizontally rotate about a vertical axis and, as such, may transfer the chuck table T2 from the second polishing chamber 120 to the dry polishing chamber 130. In addition, the turntable T1 may provide a dry-polished wafer W to the loading chamber 150. The wafer W may be held on the chuck table T2 by a negative pressure generated by a suction source (not shown).

The polishing device 160 may be disposed on the wafer W. The polishing device 160 may include a spindle 161, a spindle housing 162, a motor 163, a polishing wheel 164, and/or a polishing pad 165. The spindle 161 may be partially received in the spindle housing 162, and may be connected to the motor 163, which is disposed over the spindle housing 162. The spindle 161 may rotate about a vertical axis by the motor 163.

A lower portion of the spindle 161 may be exposed from a lower surface of the spindle housing 162. The polishing wheel 164 may be mounted to the lower portion of the polishing wheel 164. The polishing pad 165 may be attached to a lower portion of the polishing wheel 164. The polishing pad 165 may rotate about a vertical axis by the spindle 161, and may contact the wafer W. A surface of the wafer W after the primary and secondary polishing processes may be uneven, and may then be smoothed by the polishing pad 165 in the dry polishing process.

Figure 3A:
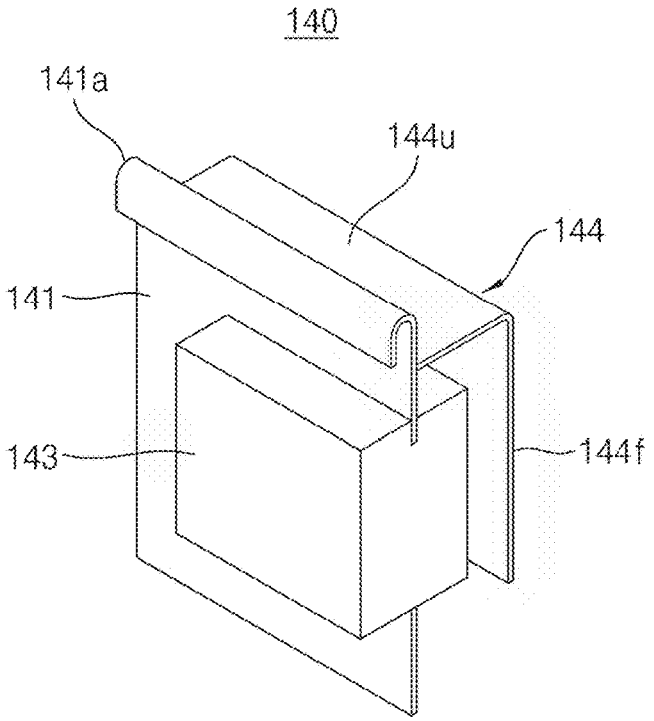
FIGS. 3A to 3C are a perspective view, a sectional view and a plan view of a chamber cover, respectively.
Figure 3B:
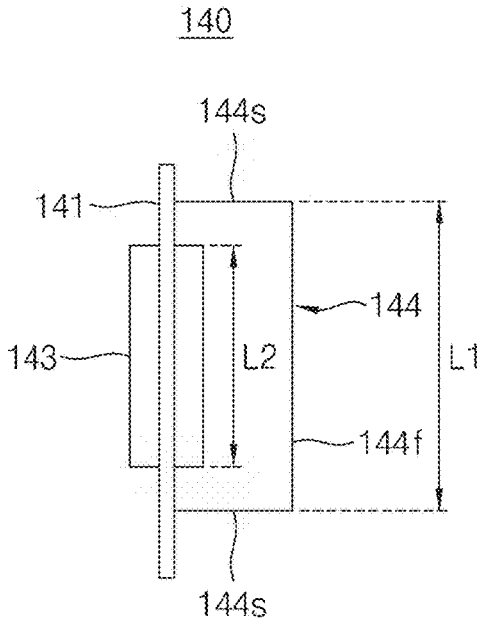
Figure 3C:
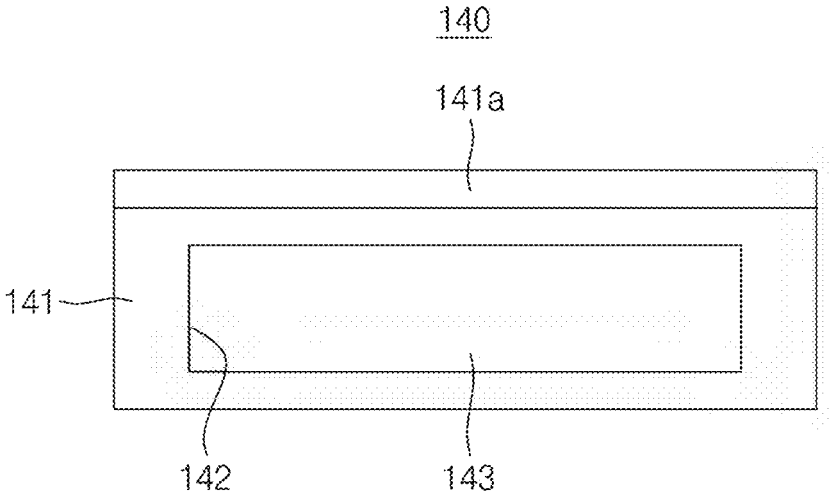

FIGS. 3A to 3C are a perspective view, a sectional view and a plan view of the chamber cover, respectively. FIG. 3A may be a perspective view of the chamber cover viewed from one end side. FIG. 3B may be a concept view of the chamber cover viewed from the top side. FIG. 3C is a concept view of the chamber cover viewed from the front side. FIG. 2 shows a side view of the chamber cover.

Referring to FIG. 2 and FIGS. 3A to 3C, the chamber cover 140 may include a cover plate 141, a handle 141*a*, an intake port 142, an interception filter 143, and/or a particle barrier 144. The cover plate 141 may constitute an outer wall of the dry polishing chamber 130, and, for example, may constitute a side wall of the dry polishing chamber 130. The handle 141*a* may be formed at an upper end of the cover plate 141. The handle 141*a* may be connected to the upper end of the cover plate 141, and may have a bent shape. For example, the handle 141*a* may have an upwardly-convex shape, and may be used as a grip for attachment/detachment of the chamber cover 140. In example embodiments, the handle 141*a* may be omitted.

The cover plate 141 may have a quadrangular plate shape, and may include the intake port 142. When the above-described upper exhaust port 132 and side exhaust port 134 suck air out of the dry polishing chamber 130, and then outwardly exhaust the sucked air, a negative pressure may be generated in the dry polishing chamber 130 by the upper exhaust port 132 and the side exhaust port 134 and, as such, ambient air may be introduced into the dry polishing chamber 130 through the intake port 142. The intake port 142 may have a quadrangular shape, without being limited thereto. In example embodiments, the intake port 142 may have a shape such as a circular shape, an oval shape, or the like. The cover plate 141 may include a metal such as stainless steel, aluminum, etc., plastic, or the like.

The interception filter 143 may be disposed in the intake port 142. For example, the interception filter 143 may be disposed to closely contact the intake port 142 such that ambient air communicates with air in the dry polishing chamber 130 only through the interception filter 143. The thickness of the interception filter 143 may be greater than the thickness of the cover plate 141. For example, the interception filter 143 may be disposed in the intake port 142, and may protrude from front and rear surfaces of the cover plate 141. In example embodiments, the interception filter 143 may be a high efficiency particulate air (HEPA) filter capable of intercepting fine particles. For example, the interception filter 143 may intercept particles having a size of 0.3 μm or more. Since the interception filter 143 is disposed in the intake port 142, the interception filter 143 may reduce or prevent particles having a predetermined or alternatively, desired size or more in the dry polishing chamber 130 from being outwardly discharged.

The particle barrier 144 may be disposed to be positioned in the dry polishing chamber 130, and may be connected to the cover plate 141. The particle barrier 144 may include a facing surface 144*f* facing the interception filter 143. For example, the facing surface 144*f* may be disposed between the polishing device 160 and the interception filter 143, and may reduce or prevent foreign matter scattered from the polishing device 160 from directly scattering to the interception filter 143. The particle barrier 144 may be disposed to completely shield the intake port 142 and the interception filter 143 from the polishing device 160, and a height H1 of the particle barrier 144 may be greater than a height H2 of the intake port 142 (shown in FIG. 2) and the interception filter 143. For example, an upper end of the particle barrier 144 may be disposed at a higher level than upper ends of the intake port 142 and the interception filter 143, and a lower end of the particle barrier 144 may be disposed at a lower level than lower ends of the intake port 142 and the interception filter 143. In addition, referring to FIG. 3B, a length L1 of the particle barrier 144 may be greater than a length L2 of the intake port 142 and the interception filter 143. For example, the intake port 142 and the interception filter 143 may be disposed between opposite longitudinal ends of the particle barrier 144.

Referring to FIGS. 2 and 3B, the particle barrier 144 may further include an upper surface 144*u* and side surfaces 144*s*. The upper surface 144*u* of the particle barrier 144 may horizontally protrude from the cover plate 141 and, as such, may be connected to the facing surface 144*f*. The side surfaces 144*s* of the particle barrier 144 may horizontally protrude from the cover plate 141 and, as such, may be connected to the upper surface 144*u* and the facing surface 144*f*. Accordingly, the particle barrier 144 may block a straight path extending from the polishing device 160 toward the intake port 142. For example, the particle barrier 144 may be open at a lower surface thereof and, as such, may provide a bypass path allowing particles produced in the polishing device 160 to move toward the intake port 142. In example embodiments, the particle barrier 144 may be open at only one of the side surfaces thereof or at only the upper surface thereof.

In the dry polishing process, a polishing solution such as a slurry, etc. may not be provided on the wafer W, differently from the primary and secondary polishing processes, and, as such, a relatively large amount of scattering particles may be produced. Generally, the intake port may introduce ambient air by a negative pressure generated by the exhaust ports and, as such, there may be a possibility that scattering particles are outwardly discharged when the flow velocity of air introduced from the outside is insufficient. However, the dry polishing chamber 130 according to example embodiments of the disclosure includes the particle barrier 144, which blocks scattering particles directly moving from the polishing device 160 to the intake port 142, and the interception filter 143 disposed at the intake port 142 and, as such, it may be possible to reduce or prevent particles produced in the dry polishing chamber 130 from being outwardly discharged.

Figure 4A:
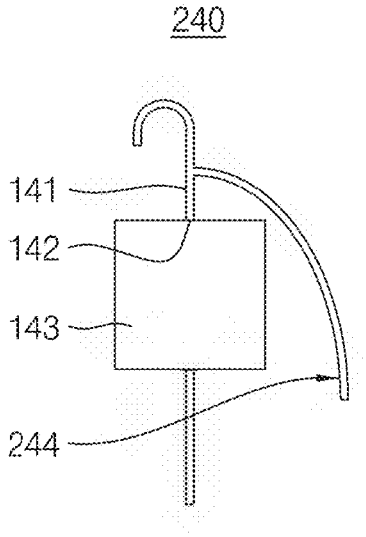
FIGS. 4A and 4B are a sectional view and a plan view of a chamber cover according to example embodiments of the present inventive concepts, respectively.
Figure 4B:
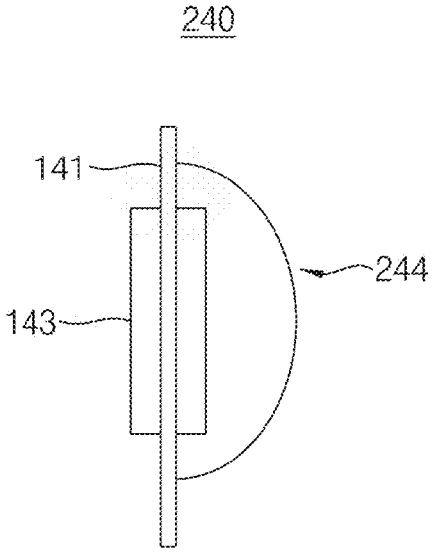

FIGS. 4A and 4B are a sectional view and a plan view of a chamber cover according to example embodiments of the present inventive concepts, respectively.

Referring to FIGS. 4A and 4B, a chamber cover 240 may include a particle barrier 244. In example embodiments, the particle barrier 244 may have a curved surface. As shown in FIG. 4A, when viewed in vertical cross-section, the particle barrier 244 may have an arc shape open at a lower surface thereof. In addition, as shown in FIG. 4B, when viewed in a top plan view, the particle barrier 244 may have a semicircular shape connected to the cover plate 141. A portion of the particle barrier 244 may face an interception filter 143. For example, an upper end of the particle barrier 244 may be disposed at a higher level than an upper end of an intake port 142 and an upper end of the interception filter 143, and a lower end of the particle barrier 244 may be disposed at a lower level than lower ends of the intake port 142 and the interception filter 143.

Figure 5A:
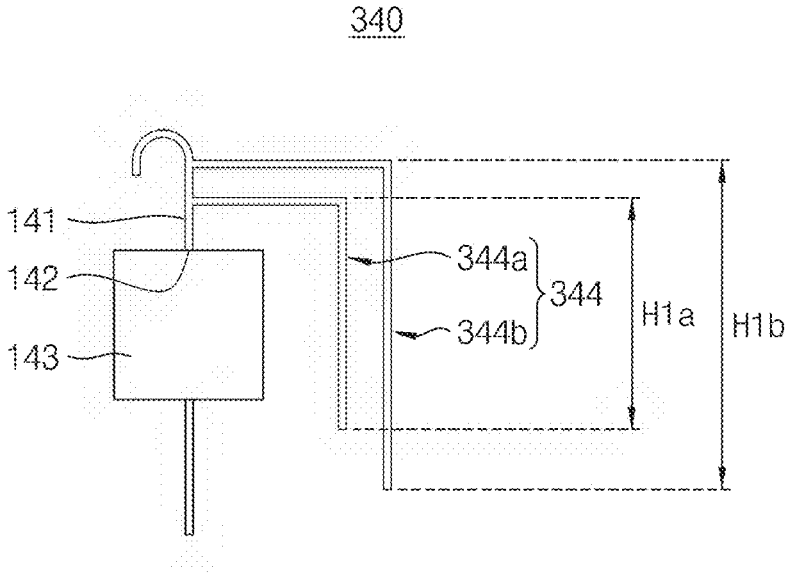
FIGS. 5A and 5B are a sectional view and a plan view of a chamber cover according to example embodiments of the present inventive concepts, respectively.
Figure 5B:
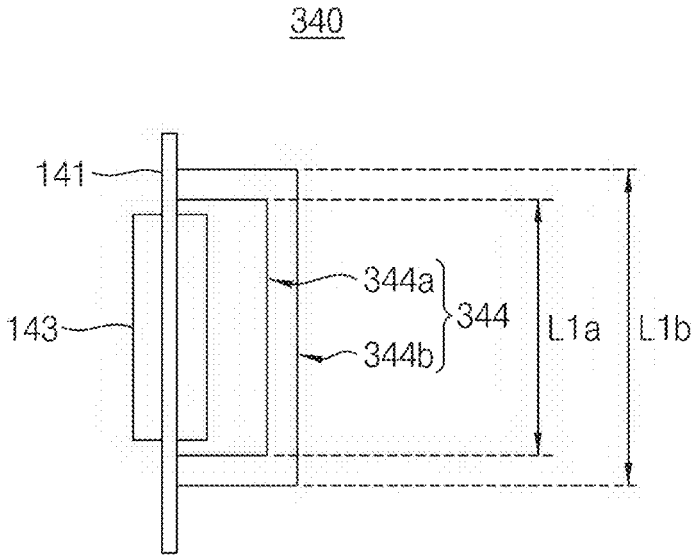

FIGS. 5A and 5B are a sectional view and a plan view of a chamber cover according to example embodiments of the present inventive concepts, respectively.

Referring to FIGS. 5A and 5B, a chamber cover 340 may include a particle barrier 344. In example embodiments, the particle barrier 344 may be constituted by a plurality of barriers. For example, the particle barrier 344 may include an inner barrier 344*a* and an outer barrier 344*b*. The inner barrier 344*a* may represent a constituent element relatively nearer to a cover plate 141 from among constituent elements of the particle barrier 344. For example, the horizontal distance from the cover plate 141 to the inner barrier 344*a* may be smaller than the horizontal distance from the cover plate 141 to the outer barrier 344*b*. Each of the inner barrier 344*a* and the outer barrier 344*b* may have an open lower surface, and may be open only at the lower surface thereof.

Referring to FIG. 5A, a height H1*a* of the inner barrier 344*a* may be smaller than a height H1*b* of the outer barrier 344*b*, without being limited thereto. In example embodiments, the height H1*a* of the inner barrier 344*a* may be greater than the height H1*b* of the outer barrier 344*b*. Referring to FIG. 5B, a length L1*a* of the inner barrier 344*a* may be smaller than a length L1*b* of the outer barrier 344*b*.

FIGS. 6 to 9 are sectional views of chamber covers according to example embodiments of the present inventive concepts, respectively. No description of configurations identical or similar to those of the particle barrier 144 shown in FIGS. 3A to 3C may be omitted.

Figure 6:
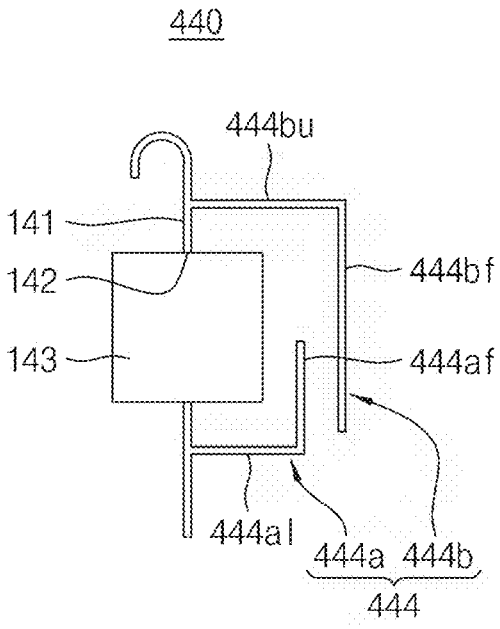
FIGS. 6 to 9 are sectional views of chamber covers according to example embodiments of the present inventive concepts, respectively.

Referring to FIG. 6, a chamber cover 440 may include a particle barrier 444 constituted by a plurality of barriers. For example, the particle barrier 444 may include an inner barrier 444*a* and an outer barrier 444*b*. In example embodiments, the inner barrier 444*a* may have an open upper surface, and the outer barrier 444*b* may have an open lower surface. That is, the inner barrier 444*a* may be open only at the upper surface thereof, and the outer barrier 444*b* may be open only at the lower surface thereof.

The inner barrier 444*a* may include a facing surface 444*af* facing an interception filter 143, and a lower surface 444*al* connected to a cover plate 141 and the facing surface 444*f*. The outer barrier 444*b* may include a facing surface 444*bf* facing the interception filter 143, and an upper surface 444*bu* connected to the cover plate 141 and the facing surface 444*f*. Although not shown, the inner barrier 444*a* and the outer barrier 444*b* may include side surfaces connected to the lower surface 444*al* and the upper surface 444*bu*, respectively. The facing surface 444*af* and the facing surface 444*bf* may overlap in a horizontal direction. The upper surface 444*bu* and the lower surface 444*al* may overlap with each other in a vertical direction.

Figure 7A:
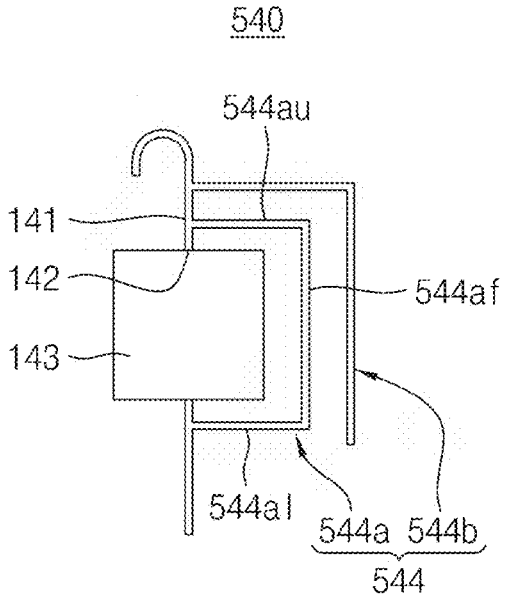
Figure 7B:
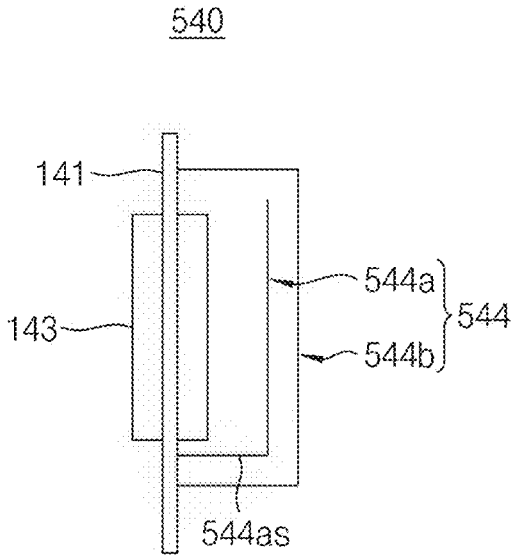

FIGS. 7A and 7B are a sectional view and a plan view of a chamber cover according to example embodiments of the disclosure.

Referring to FIGS. 7A and 7B, a chamber cover 540 may include a particle barrier 544 including an inner barrier 544*a* and an outer barrier 544*b*. In example embodiments, the inner barrier 544*a* may have an open side surface, and the outer barrier 544*b* may include an open lower surface. That is, the inner barrier 544*a* may be open only at one of side surfaces thereof, and the outer barrier 544*b* may be open only at the lower surface thereof. The inner barrier 544*a* may include a facing surface 544*af* facing an interception filter 143, and an upper surface 544*au* and a lower surface 544*al* connected to a cover plate 141 and the facing surface 544*af*. The inner barrier 544*a* may include one side surface 544*as* connected to the lower surface 544*al*, the upper surface 544*au* and the facing surface 544*af*. The outer barrier 544*b* may include a configuration identical or similar to the outer barrier 444*b*.

Figure 8:
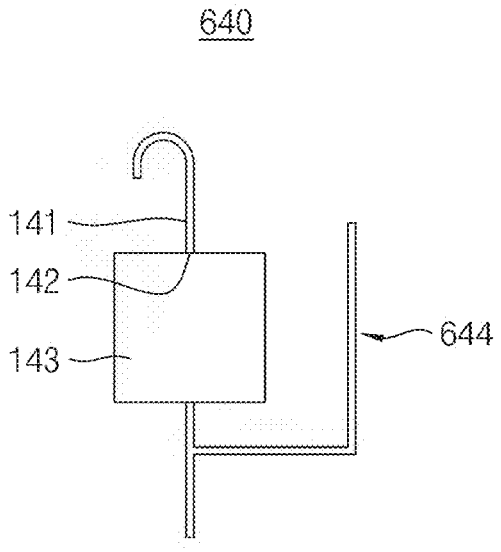

Referring to FIG. 8, a chamber cover 640 may include a particle barrier 644. In example embodiments, the particle barrier 644 may have an open upper surface. That is, the particle barrier 144 may be open only at the upper surface thereof.

Figure 9:
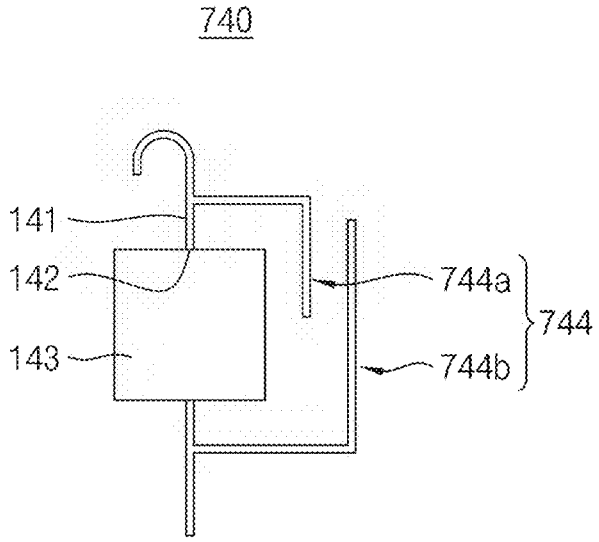

Referring to FIG. 9, a chamber cover 740 may include a particle barrier 744 including an inner barrier 744*a* and an outer barrier 744*b*. In example embodiments, the inner barrier 744*a* may have an open lower surface, and the outer barrier 744*b* may have an open upper surface. That is, the inner barrier 744*a* may be open only at the lower surface thereof, and the outer barrier 744*b* may be open only at the upper surface thereof.

Figure 10:
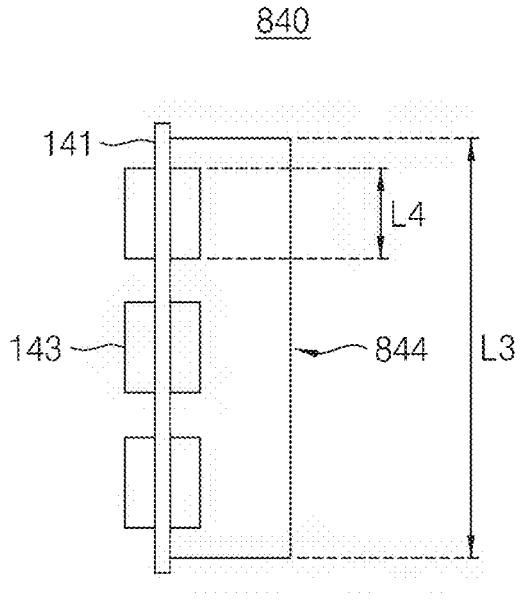
FIGS. 10 to 12 are plan views of chamber covers according to example embodiments of the present inventive concepts, respectively.
Figure 11:
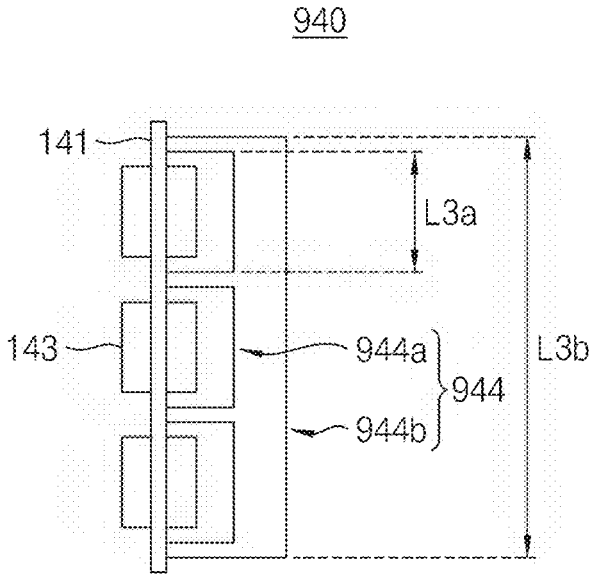
Figure 12:
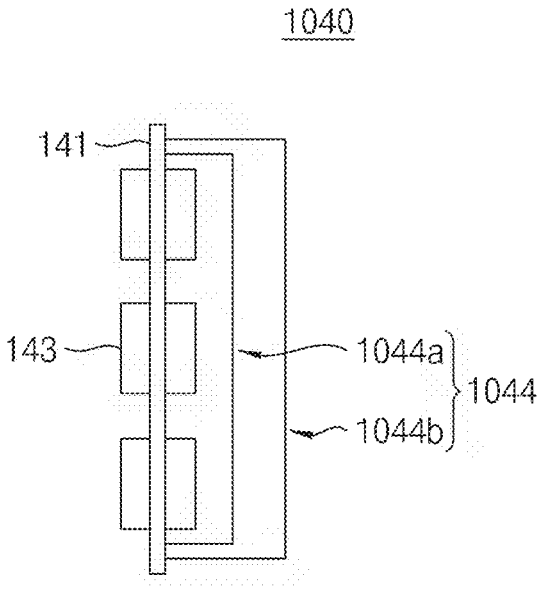

FIGS. 10 to 12 are plan views of chamber covers according to example embodiments of the present inventive concepts, respectively.

Referring to FIG. 10, a chamber cover 840 may include a plurality of interception filters 143 and a particle barrier 844. For example, the chamber cover 840 may include a plurality of intake ports 142, and each interception filter 143 may be disposed in a corresponding one of the intake ports 142. The interception filters 143 may be disposed to be spaced apart from one another.

The particle barrier 844 may be disposed to face all of the plurality of interception filters 143. For example, a length L3 of the particle barrier 844 may be greater than the sum of lengths L4 of the interception filters 143. For example, all of the interception filters 143 may be disposed between opposite longitudinal ends of the particle barrier 844. Although the interception filters 143 are shown in FIG. 10 as having the same length, example embodiments of the disclosure are not limited thereto. In example embodiments, the interception filters 143 may have different lengths, respectively. In example embodiments, the particle barrier 844 may be open only at one of side, upper and lower surfaces thereof, and, for example, may be open only at the lower surface thereof.

Referring to FIG. 11, a chamber cover 940 may include a plurality of interception filters 143 and a particle barrier 944. In example embodiments, the particle barrier 944 may be constituted by a plurality of barriers. For example, the particle barrier 944 may include inner barriers 944*a* and an outer barrier 944*b*. Each inner barrier 944*a* may be disposed to face a corresponding one of the interception filters 143. The outer barrier 944*b* may be disposed to face all of the inner barriers 944*a*. For example, a length L3*b* of the outer barrier 944*b* may be greater than the sum of lengths L3*a* of the inner barriers 944*a*. The length of each inner barrier 944*a* may be greater than the length of the corresponding interception filter 143. All of the inner barriers 944*a* may be disposed between opposite longitudinal ends of the outer barrier 944*b*. Although the inner barriers 944*a* are shown in FIG. 11 as having the same length, example embodiments of the disclosure are not limited thereto. In example embodiments, the inner barriers 944*a* may have different lengths, respectively. The inner barriers 944*a* and the outer barrier 944*b* may have configurations identical or similar to those illustrated in FIGS. 5A to 7B. For example, the outer barrier 944*b* may be open at a lower surface thereof, and the inner barrier 944*a* may be open at one of lower, upper and side surfaces thereof.

Referring to FIG. 12, a chamber cover 1040 may include a plurality of interception filters 143 and a particle barrier 1044 including a plurality of barriers. In example embodiments, the particle barrier 1044 may include an inner barrier 1044*a* and an outer barrier 1044*b*. The inner barrier 1044*a* may be disposed to face all of the interception filters 143. For example, all of the interception filters 143 may be disposed between opposite longitudinal ends of the inner barrier 1044*a*.

In accordance with example embodiments of the disclosure, it may be possible to reduce or prevent foreign matter in a dry polishing device from being outwardly discharged.

While example embodiments of the disclosure have been described with reference to the accompanying drawings, it should be understood by those skilled in the art that various modifications may be made without departing from the scope of the disclosure and without changing essential features thereof. Therefore, the above-described example embodiments should be considered in a descriptive sense only and not for purposes of limitation.

What is claimed is:

1. A substrate processing apparatus comprising:

a first polishing chamber, a second polishing chamber, a dry polishing chamber and a loading chamber on a turntable;

wherein the dry polishing chamber includes a polishing device on the turntable, and a chamber cover including a cover plate, an interception filter at an intake port at the cover plate, and a particle barrier connected to the cover plate, wherein the particle barrier faces the interception filter, and is between the polishing device and the interception filter.

2. The substrate processing apparatus according to claim 1, wherein the interception filter is a high efficiency particulate air (HEPA) filter.

3. The substrate processing apparatus according to claim 1, wherein:

the particle barrier includes a facing surface facing the interception filter;

the facing surface is between the polishing device and the interception filter; and a height of the facing surface is greater than a height of the interception filter.

4. The substrate processing apparatus according to claim 3, wherein a length of the facing surface is greater than a length of the interception filter.

5. The substrate processing apparatus according to claim 1, wherein the particle barrier is open only at a lower surface thereof.

6. The substrate processing apparatus according to claim 5, wherein the particle barrier includes:

a facing surface facing the interception filter;

an upper surface interconnecting the cover plate and the facing surface; and side surfaces connected to the cover plate, the facing surface and the upper surface.

7. The substrate processing apparatus according to claim 1, wherein the particle barrier has a curved surface.

8. The substrate processing apparatus according to claim 1, wherein:

the particle barrier includes an outer barrier and an inner barrier; and a horizontal distance from the cover plate to the inner barrier is smaller than a horizontal distance from the cover plate to the outer barrier.

9. The substrate processing apparatus according to claim 8, wherein each of the outer barrier and the inner barrier is open only at a lower surface thereof.

10. The substrate processing apparatus according to claim 8, wherein the outer barrier is open only at a lower surface thereof, and the inner barrier is open only at an upper surface thereof.

11. The substrate processing apparatus according to claim 8, wherein the outer barrier is open only at a lower surface thereof, and the inner barrier is open only at one side surface thereof.

12. The substrate processing apparatus according to claim 8, wherein the outer barrier is open only at an upper surface thereof, and the inner barrier is open only at a lower surface thereof.

13. The substrate processing apparatus according to claim 1, wherein the chamber cover is at a side wall of the dry polishing chamber.

14. A substrate processing apparatus comprising:

a first polishing chamber, a second polishing chamber, a dry polishing chamber and a loading chamber on a turntable;

wherein the dry polishing chamber includes a polishing device on the turntable, and a chamber cover including a cover plate, a plurality of interception filters at an intake port at the cover plate, and a particle barrier connected to the cover plate, wherein the particle barrier faces the plurality of the interception filters, and is between the polishing device and the interception filters.

15. The substrate processing apparatus according to claim 14, wherein a length of the particle barrier is greater than a sum of lengths of the plurality of interception filters.

16. The substrate processing apparatus according to claim 14, wherein:

the particle barrier includes an outer barrier and an inner barrier; and the inner barrier faces all of the plurality of interception filters.

17. The substrate processing apparatus according to claim 14, wherein:

the particle barrier includes an outer barrier and a plurality of inner barriers;

each of the inner barriers faces a corresponding one of the plurality of interception filters; and the outer barrier faces all of the plurality of inner barriers.

18. The substrate processing apparatus according to claim 17, wherein a length of each of the inner barriers is greater than a length of the corresponding interception filter, and is smaller than a length of the outer barrier.

19. A substrate processing apparatus comprising:

a first polishing chamber, a second polishing chamber, a dry polishing chamber and a loading chamber on a turntable;

wherein the dry polishing chamber includes an upper exhaust port and a side exhaust port at an upper surface and a side surface of the dry polishing chamber, respectively, a chuck table on the turntable, a polishing device on the chuck table, the polishing device including a spindle, and a polishing wheel under the spindle, and a chamber cover including a cover plate, an interception filter at an intake port at the cover plate, and a particle barrier connected to the cover plate, wherein the particle barrier faces the interception filter, is between the polishing device and the interception filter, and is open only at a lower surface thereof.

20. The substrate processing apparatus according to claim 19, wherein:

the particle barrier includes a facing surface facing the interception filter;

the facing surface is between the polishing device and the interception filter; and a height of the facing surface is greater than a height of the interception filter.

* * * * *